United States Patent [19]

McClurg

[11] Patent Number: 4,595,109

[45] Date of Patent: Jun. 17, 1986

[54] COUPLER FOR ROTARY DUMP CARS

[75] Inventor: Carl D. McClurg, Lockbourne, Ohio

[73] Assignee: Buckeye International, Inc., Columbus, Ohio

[21] Appl. No.: 525,467

[22] Filed: Aug. 22, 1983

[51] Int. Cl.[4] ..... B61G 9/00

[52] U.S. Cl. ..... 213/62 A; 213/61

[58] Field of Search ..... 213/62 A, 67–72, 213/60, 61

[56] References Cited

U.S. PATENT DOCUMENTS 2,869,736 1/1959 Wolfe ..... 213/72

3,709,376 1/1973 Altherr ..... 213/72 X

*Primary Examiner*—David A. Scherbel

*Assistant Examiner*—Glenn B. Foster

*Attorney, Agent, or Firm*—Charles F. Pigott, Jr.

[57] ABSTRACT

A coupler for rotary dump cars having a coupler head cast integral with a rotating spindle. The coupler includes a widened shank-spindle housing to accommodate the enlarged end of the spindle for better load characteristics.

11 Claims, 10 Drawing Figures

COUPLER FOR ROTARY DUMP CARS

BACKGROUND OF THE INVENTION

This invention relates in general to railroad cars and, in particular, to a coupler for rotary dump cars.

More specifically, but without restriction to the particular use which is shown and described, this invention relates to a coupler having an improved design in which bearing areas between the coupler spindle and the shank-spindle housing are increased for better strength and for minimizing stress concentrations at all bearing locations. The coupler spindle is provided with an enlarged, inboard end to cooperate with the increased size of the shank-spindle housing.

The use of a rotary dump railroad car has attracted considerable attention in recent years. Rotary dump railcars are particularly useful in unit trains which are in dedicated service delivering coal or other materials to electric power stations or other destinations. The cars may be unloaded by simply moving the train through a rotary dumper, positioning each car in the dumper, and rotating it to allow the coal to discharge. This operation is accomplished while the cars remain coupled. Because of the rotary movement of one car relative to another, the coupler is subjected to forces which would not be experienced in non-rotating designs. The coupler must be able to permit the rotation of a car with respect to the adjacent cars and resist the multiple forces encountered in use of such rotary cars.

One coupler design for connecting rotary dump cars is disclosed in U.S. Pat. No. 2,869,736 issued Jan. 20, 1959, for a Railway Coupler. Although the assembly described in U.S. Pat. No. 2,869,736 is directed to a coupler having a satisfactory design, it was found that certain improvements could be made to the structure disclosed in the patent. One shortcoming of the prior couplers, such as shown in the patent and others employed in the industry, is the inadequacy of design and a tendency to be overstressed because of undesired stress concentrations. To overcome such problems, many new designs have been introduced to better serve the railroad industry and to provide an adequate coupler for rotary conditions.

It is desirable in providing such a stronger component that it be usable without requiring substantial modifications of existing striking castings at the end of center sill and standard draft yokes which cooperate with the draft gear, a cushion unit used in each end of railcars. None of the current couplers are capable of demonstrating enhanced strength and superb characteristics with a design that can inexpensively be interchanged with conventional draft arrangements.

SUMMARY OF THE INVENTION

It is, therefore, an object of this invention to provide an improved coupler for rotary dump railcars.

Another object of this invention is to provide an improved coupler for rotary dump cars in which the structural design of the coupler is enhanced to resist the forces applied to the assembly during use.

A further object of this invention is to provide an improved design for a rotary coupler in which the bearing areas between coupler spindle and shank-spindle housing surfaces are enlarged for better strength, wear resistance and effectiveness of rotation.

Still another object of this invention is to increase the size of the shank-spindle housing and load-bearing portion of the spindle for increased strength without interference with the remainder of the structure of the rotary dump car.

A still further object of this invention is to provide a coupler for rotary dump cars capable of substantially adapting for use with standard castings and standard draft yokes with little modification for increased economy of manufacture and use.

These and other objects are attained in accordance with the present invention wherein there is provided an improved coupler for rotary dump cars in which the strength of the coupler is greatly increased due to a unique design. The bearing areas between the coupler spindle and the shank-spindle housing are enlarged at locations that tend to be overstressed in use. The bearing surfaces are formed with enlarged radiuses in a manner to minimize stress concentrations at such high-load locations. The coupler has an improved design by which the shank-spindle housing and coupler spindle cooperate in a manner to provide increased strength without interferring with the striking casting normally positioned at the end of the center sill. In addition, the coupler of the invention permits use of a conventional striking casting with only a slightly modified draft yoke that is fully interchangeable with a standard yoke.

DESCRIPTION OF THE DRAWINGS

Further objects of the invention together with additional features contributing thereto and advantages accruing therefrom will be apparent from the following description of a preferred embodiment of the invention which is shown in the accompanying drawings with like reference numerals indicating corresponding parts throughout, wherein.

DESCRIPTION OF THE PREFERRED EMBODIMENT

Figure 1:
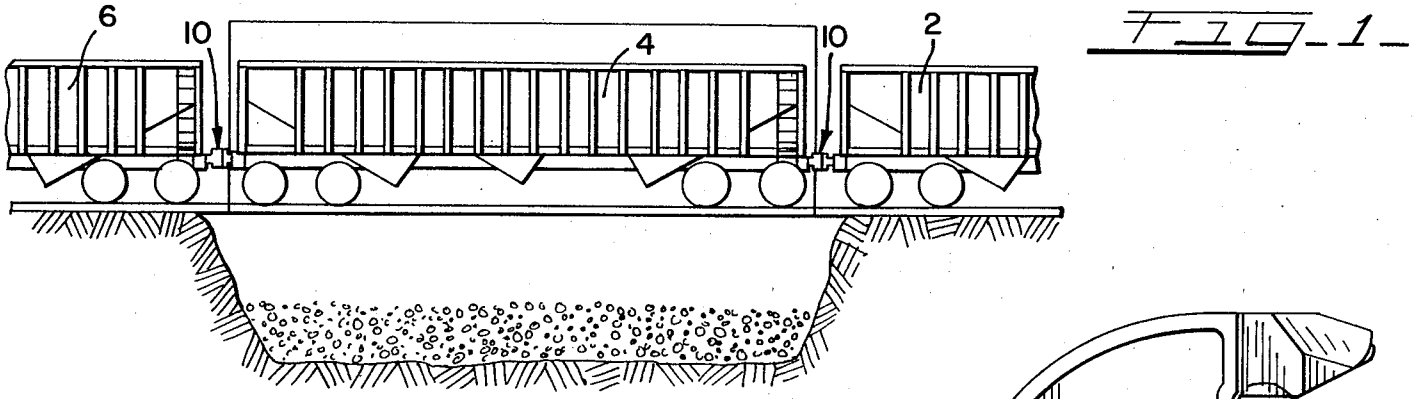
FIG. 1 is a side schematic view of a typical rotary railway dump car positioned over an unloading area employing the improved coupler of the invention.

Referring now to FIG. 1, there are illustrated conventional rotary dump cars 2, 4, 6, interconnected by the coupler of the invention, generally designated by reference numeral 10. In operation of rotary dump cars, such as shown in FIG. 1, a particular car is positioned over a dump site, i.e., dump car 4 in FIG. 1 and a dumper mechanism (not shown) causes the car to rotate about the longitudinal axis of the coupler to dump the contents into the site beneath the car. Such rotation of the dump car is attained while the immediate forward and aft cars 2 and 6 remain upright. Thus, the rotary coupler not only must sustain the compressive and tensile loads normally applied to it for pulling the cars, but must permit relative rotary movement between adjacent cars being dumped.

Figure 2:
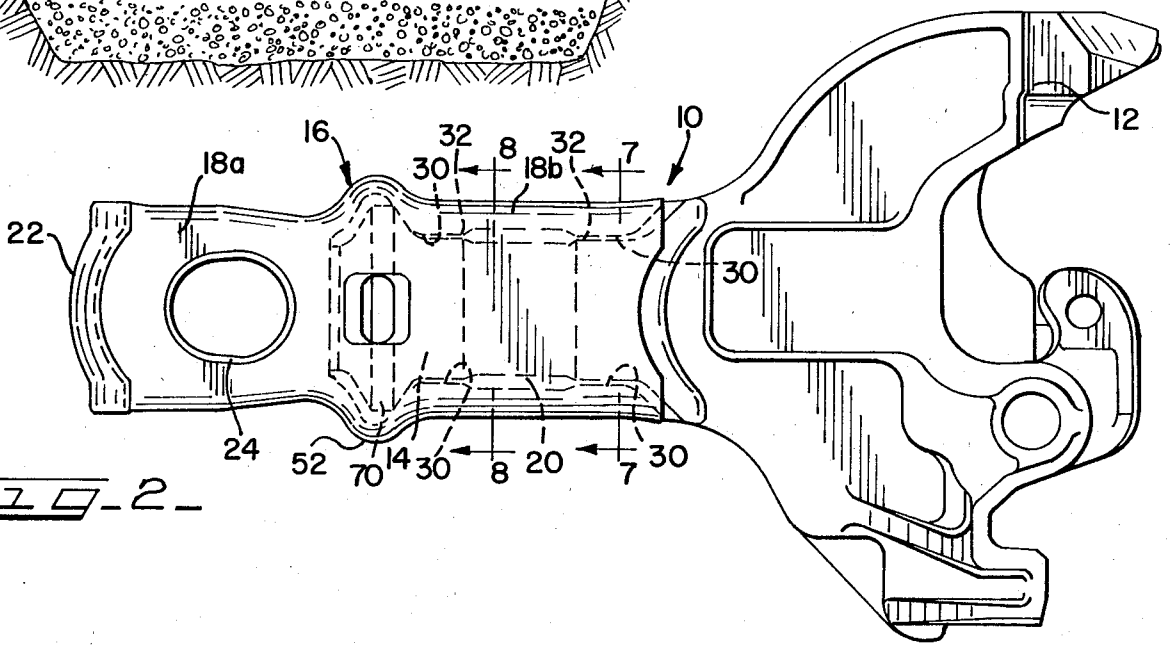
FIG. 2 is a top plan view of the improved coupler.
Figure 3:
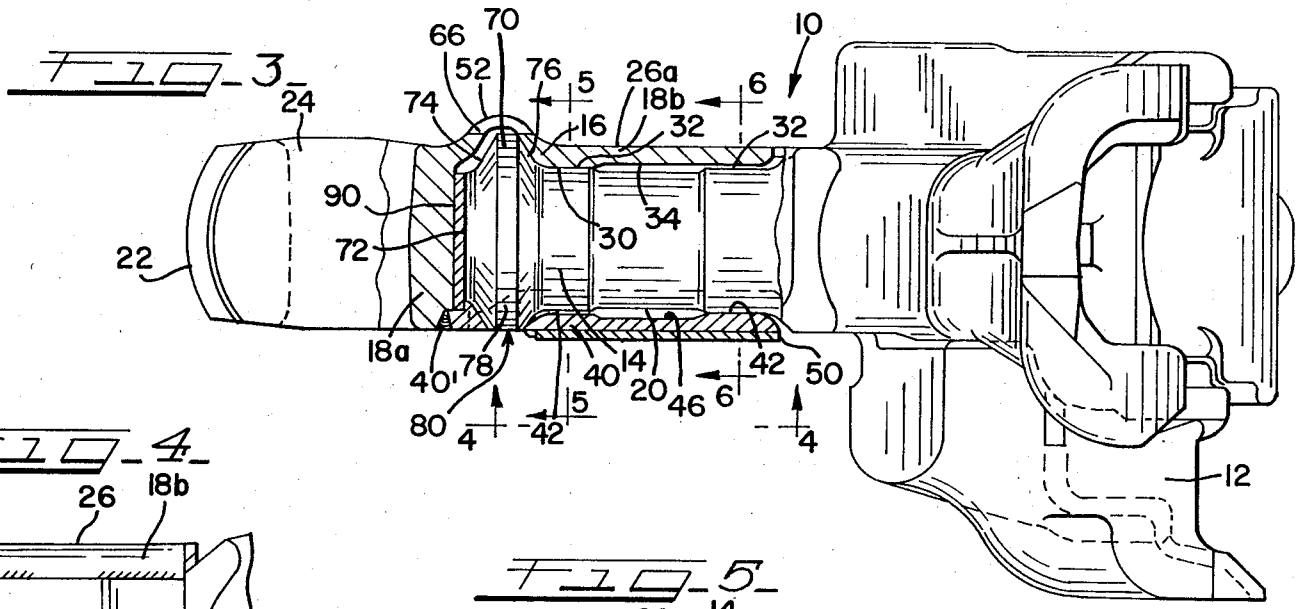
FIG. 3 is a side view, with parts in section, of the coupler of FIG. 2.
Figure 4:
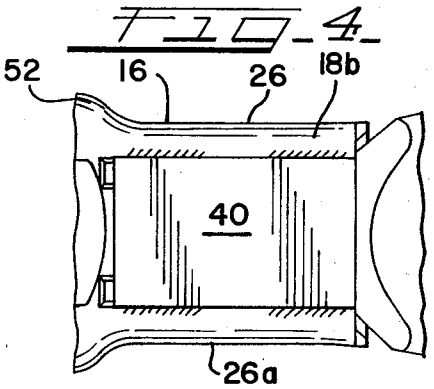
FIG. 4 is a partial bottom view taken along lines 4—4 of FIG. 3.

Referring now to FIGS. 2 and 3, the improved coupler 10 for rotary dump cars of the invention is best shown. The invention may be utilized with all common types of couplers and in the figures is shown in relation to a standard type "F" coupler head 12. The coupler head 12 is intended to remain in coupled relationship with the non-rotating coupler of adjacent upright railroad vehicle, even when the railroad car undergoes a rotary dumping action as discussed in relation to FIG. 1.

Figures 7, 8, 9, 10:
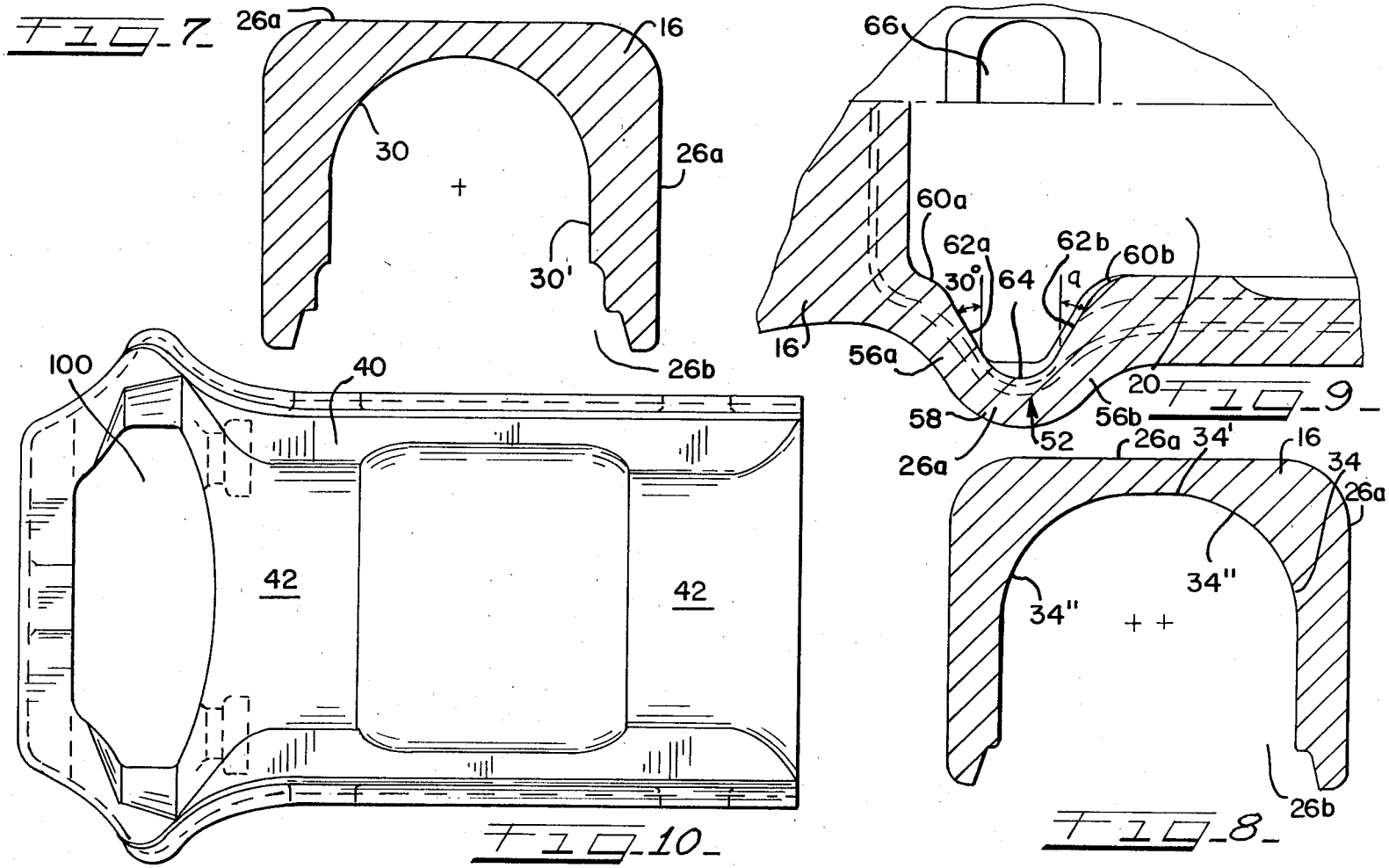
FIG. 7 is a cross-sectional view taken along line 7—7 of FIG. 2 with the coupler spindle and bottom enclosure casting removed.
FIG. 8 is a cross-sectional view taken along line 8—8 of FIG. 2 with the coupler spindle and bottom enclosure casting removed.
FIG. 9 is a partial enlarged view of the expanded portion of the shank-spindle housing.
FIG. 10 is a top plan view of the shankspindle housing bottom enclosure casting.

The coupler head 12 is provided with a rear, integral extension or spindle 14 that is arranged to cooperate with an outer shank-spindle housing 16 in a manner to be described. The shank-spindle housing 16 includes an inboard generally solid end 18*a* and outboard end 18*b* surrounding three sides of an elongated cavity 20 for receiving the spindle 14 and permitting relative movement of the shank-spindle housing 16 about the axis of the spindle 14. The inboard face of the shank-spindle housing 16 is provided with a spherical shape butt end 22 to cooperate with the follower of a draft assembly as is known. A hole 24 extends through inboard end 18*a* to receive a pin (not shown) coupling the components to the nose portion of a yoke (not shown). The outboard end 18*b* of the shank-spindle housing 16 includes a body having three generally flat outer surfaces 26*a* and open bottom 26*b* as shown in FIGS. 7 and 8.

Figure 5:
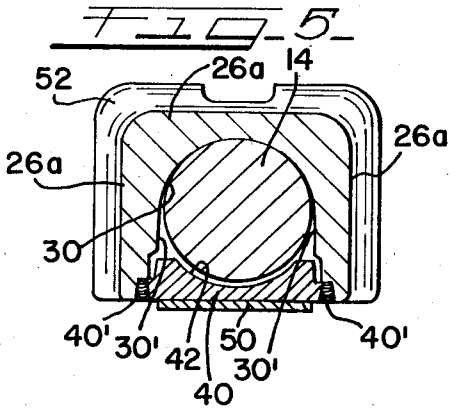
FIG. 5 is an end sectional view taken along line 5—5 of FIG. 3 showing the bearing contact between the spindle and the bearing surfaces of the shank-spindle housing.
Figure 6:
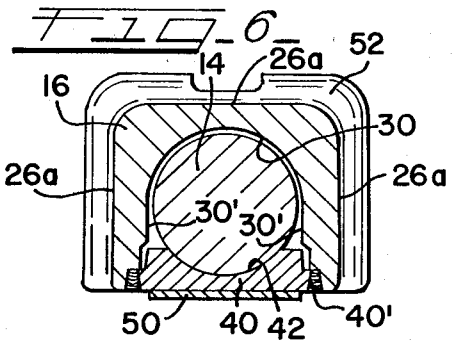
FIG. 6 is an end sectional view taken along line 6—6 of FIG. 3 and showing bearing contact between the spindle and the shank-spindle housing at a different position.

The internal cavity 20 is opened at the end adjacent the coupler head 12 and includes a pair of spaced, cylindrical bearing surfaces 30 which are arranged to cooperate with raised bosses 32 formed on cylindrical surfaces on the periphery of the spindle 14. The bearing surfaces 30 are elongated and form the areas of narrowest restriction of the cavity 20 as seen in FIGS. 5, 6 and 7. Each bearing surface 30 is cylindrical in shape and disposed for approximately 180° about the longitudinal axis of the coupler. The bearing surfaces 30 on each side terminate with flat surfaces 30' near the bottom of end 26. The distance of surface 30' from the vertical axis of the coupler is approximately equal to the radius of the inboard and outboard bearing surfaces 30.

An enlarged non-continuous portion 34 in the wall of the shank-spindle housing 16 separates the bearing areas as illustrated in FIGS. 5 and 6. The points 34' of portion 34 lying on the vertical centerline of the coupler are at an equal radius to the radius of curvature of the bearing surfaces 30 as best shown in FIG. 8. The remaining portions 34" around portion 34 on each side of the centerline are defined by equal radiuses of curvature measured from spaced centers lying on opposite sides of the vertical centerline with a resulting enlargement of the cavity between the spaced bearing surfaces 30.

The open bottom 26*b* of the shank-spindle housing 16 is designed to accept a bottom enclosure casting 40 suitably welded at areas 40' (FIGS. 3, 5 and 6) to the shank-spindle housing 16 and likewise is formed with spaced bearing surfaces 42 within its curved internal surface as best shown in FIGS. 5 and 6, separated by enlarged areas 46 generally to complement corresponding areas in the shank-spindle housing 16. Further as seen in FIGS. 5 and 6, the enlarged bosses 32 formed on the spindle 14 of the coupler head are arranged to bear longitudinally against the spaced bearing surfaces 30 and 42 provided by the combined shank-spindle housing 16 and bottom enclosure casting 40. The radiuses of the bearing surfaces 30 and bosses 32 are created by relatively increased radiuses of curvature at their mating edge portions to prevent the formation of weakened areas caused by stress concentrations existing at the high load levels being applied between the spindle 14 and shank-spindle housing 16. As seen in FIGS. 3, 5 and 6, a flat wear plate 50 is affixed to the bottom enclosure casting.

As best seen in FIGS. 3 and 9, the inboard end of the cavity 20 is surrounded by enlarged configuration of portion 52 forming a seat area having an increased internal diameter projecting beyond the remainder of the cavity. The portion 52 is created by bulging out the walls 26*a* that appear as continuous raised periphery as best seen in FIGS. 5 and 6. The walls 56*a*, 56*b* of raised area 52 respectively flare outward from the inboard end 18*a* of the shank-spindle housing 16 and the inboard bearing 30 and terminate at a peripheral wall portion 58. The inner surface of walls 56*a* and 56*b* include inner curved portions 60, 60*b* and adjacent sloped, generally flat surfaces 62*a*, 62*b*, each disposed on a plane lying at a suitable angle with respect to the lateral axis of the coupler as shown in FIG. 9. Surfaces 62*a* and 62*b* are connected by an intermediate surface 64 situated at the outermost diameter of cavity 20. As seen in the sectional view of FIGS. 3 and 9, the outer wall portion 58 includes an opening 66.

The configuration of portion 70 at the inboard end of the stem 14 is widened adjacent to flat end 72 to mate with the enlarged cavity provided by portion 52 of the shank-spindle housing 16. The widened end 70 creates faces 74 and 76 having an approximate truncated cone shape and being interconnected by an annular surface 78. The surface is formed with flat area 80 on its periphery confronting opening 100. The annular surface 78 is designed to be in generally spaced radial relationship to intermediate surface 64 of the shank/housing 16. The longitudinal width of portion 70 is less than the corresponding dimensions of portion 52 of the shank-spindle housing 16. The face 76 is arranged to bear against surface 62*b* during tensile loads and surface 72 bears against shim plate 90, which in turn rests against surface 18*a* during buff loads. This is best shown in FIGS. 3 and 9.

The bottom enclosure casting 40 accommodates the widened end of the spindle 14 in opening 100 disposed at its inboard end as shown in FIG. 10. A shim plate 90 is imposed between the end of rotating element 14 and the inboard end wall of the cavity 20. The unique location of enlarged section 52 in the shank-spindle housing 16 near center pin hole 24 provides increased strength without interference with the swiveling of the coupler, which would occur if the enlarged structure had been located at the striking casting at the end of the center sill. The inboard end 72 of the spindle 14 extends close to the pin hole 24 and the shim 90 provides increased wear resistance and absorption of the slack in the coupler.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A coupler for railroad cars comprising:

a coupler head having a spindle extending therefrom toward the railcar on which the coupler head is carried;

said spindle having an enlarged portion adjacent the free end thereof, said enlarged portion having sloped inboard and outboard facing surfaces;

said spindle further having a spaced pair of external bearing surfaces other than said enlarged portion, arranged for rotary contact with a housing means;

said housing means having an inboard portion for receiving a yoke connecting pin and an outboard portion having an elongated cavity for surrounding said spindle;

said outboard portion having an outwardly extending enlarged sidewall configuration adjacent to said cavity for receiving said enlarged portion of said spindle for increased strength of the coupler;

said outboard surface of said spindle arranged to engage surfaces of said enlarged sidewall configuration depending on the presence of tensile forces, said inboard surface of said enlarged portion arranged to bear against the inboard wall of said cavity of said spindle housing through an intermediate filler plate; and bearing means on said housing means for contacting said spaced pair of bearing surfaces of said spindle to allow rotary movement of said housing means relative to said spindle.

2. The coupler according to claim 1 wherein said outboard portion of said housing means includes angularly oriented integral walls for surrounding said cavity on three sides and forming an open side, a base plate attached to said housing for enclosing said open side.

3. The coupler according to claim 2 wherein said base plate includes an internal surface defining a part of said cavity, said internal surface having bearing means corresponding to said bearing means of said outboard portion of said housing means for contacting said spaced bearing surfaces of said spindle.

4. The coupler according to claim 2 wherein said base plate includes an opening for receiving a peripheral area of said enlarged portion of said spindle.

5. The coupler according to claim 1 wherein said inboard and outboard spindle surfaces have oppositely facing truncated conical shapes.

6. The coupler according to claim 5 wherein said inboard and outboard surfaces are sloped at approximately 30° to the lateral axis of said spindle, said walls of said enlarged sidewalls configuration having a complimentary slope thereto.

7. The coupler according to claim 1 wherein a shim is positioned between the end of said spindle and the end of said cavity formed by said housing means.

8. The coupler according to claim 1 wherein no shim is positioned between the end of said spindle and the end of said cavity formed by said housing means.

9. The coupler according to claim 1 wherein the outermost peripheral areas of said enlarged portion of said spindle is radially spaced within the outermost internal radial points of said enlarge configuration of said housing means.

10. The coupler according to claim 1 wherein said enlarged portion of said spindle includes an annular surface between said inboard and outboard facing surfaces.

11. The coupler according to claim 1 wherein said enlarged portion of said spindle is located near said yoke connecting pin.

* * * * *